US008060974B2

(12) United States Patent
McLogan

(10) Patent No.: US 8,060,974 B2
(45) **Date of Patent: *Nov. 22, 2011**

(54) FOOT-WORN SCRUBBING APPARATUS

(76) Inventor: Lisa K. McLogan, Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/961,287

(22) Filed: Dec. 6, 2010

(65) Prior Publication Data

US 2011/0072606 A1 Mar. 31, 2011

Related U.S. Application Data

(63) Continuation of application No. 11/684,609, filed on Mar. 10, 2007, now Pat. No. 7,845,043.

(51) Int. Cl.
*A47L 13/282* (2006.01)
*A43B 5/08* (2006.01)

(52) U.S. Cl. ..... 15/227; 36/8.1; 36/136

(58) Field of Classification Search ..... 15/227; 36/8.1, 136

See application file for complete search history.

(56) References Cited

U.S. PATENT DOCUMENTS 1,136,150 A 4/1915 McGrath, III
1,287,487 A 12/1918 Smith
1,915,333 A 6/1933 Rosenblum
2,075,850 A 4/1937 Johnson
2,382,559 A 8/1945 Goldstein
2,571,606 A 10/1951 Peterson
2,738,533 A 3/1956 Peterson
2,790,191 A 4/1957 Johnson
2,839,845 A 6/1958 Burton, Jr.
3,050,761 A 8/1962 Morgan
3,121,962 A 2/1964 Gullo
3,226,751 A 1/1966 Lemelson
3,359,591 A 12/1967 McGuire
3,362,775 A 1/1968 Meuke
3,460,182 A 8/1969 Grande
3,526,014 A 9/1970 Edwards
3,526,917 A 9/1970 Haywood, Jr.
3,603,006 A 9/1971 Davenport et al.
3,680,170 A 8/1972 Sims
3,699,672 A 10/1972 Sims
3,874,100 A 4/1975 Schwitters
3,969,026 A 7/1976 Johnson
4,697,295 A 10/1987 Garrison
4,811,444 A 3/1989 Hamblin
4,896,439 A 1/1990 Morgan
4,924,608 A 5/1990 Mogonye
4,945,599 A 8/1990 Flynn
5,144,759 A 9/1992 Mascotte
5,173,985 A 12/1992 Palmer (Continued)

OTHER PUBLICATIONS

Clorox BathWand System, http://www.clorox.com/solutions_bathwand.php, Feb. 28, 2007.

(Continued)

*Primary Examiner* — Randall Chin

(74) *Attorney, Agent, or Firm* — Mnemoglyphics, LLC; Lawrence M. Mennemeier

(57) ABSTRACT

Embodiments of foot-worn scrubbing apparatus are disclosed. One embodiment of the apparatus includes a sole made of a suitable sponge material and having a top surface and a bottom surface. A scrubbing surface of another suitable scrubbing material is adhered to the bottom surface of the sole. The sole is also attached to a thong in order to secure the sole and the scrubbing surface to a bare foot or to a socked foot of a user.

20 Claims, 7 Drawing Sheets

U.S. PATENT DOCUMENTS

| | | | |
|---|---|---|---|
| 5,331,705 | A | 7/1994 | Melov |
| 5,408,718 | A | 4/1995 | Sadovsky |
| 5,473,788 | A | 12/1995 | Aragona |
| 5,613,897 | A | 3/1997 | Thompson, Jr. |
| 5,640,788 | A | 6/1997 | Thange |
| 5,644,813 | A | 7/1997 | Puskas |
| 5,881,423 | A | 3/1999 | Shumway |
| 5,921,003 | A | 7/1999 | Kim |
| 5,943,792 | A | 8/1999 | Powell |
| 5,974,698 | A | 11/1999 | Nash et al. |
| 6,038,726 | A | 3/2000 | Kelly et al. |
| 6,047,434 | A | 4/2000 | Falwell |
| 6,052,856 | A | 4/2000 | DeMoya et al. |
| 6,122,793 | A | 9/2000 | Pao |
| 6,134,741 | A | 10/2000 | Spalione |
| 6,145,156 | A | 11/2000 | Pullara, Jr. et al. |
| 6,273,628 | B1 | 8/2001 | Chen |
| 6,393,648 | B1 | 5/2002 | Reynolds |
| 6,430,771 | B2 | 8/2002 | Ahern |
| 6,446,300 | B1 | 9/2002 | Sleezer |
| 6,848,200 | B1 | 2/2005 | Westin |
| 2004/0040110 | A1 | 3/2004 | Fletcher et al. |
| 2004/0049944 | A1 | 3/2004 | Lee |
| 2005/0166943 | A1 | 8/2005 | Owens |
| 2005/0177968 | A1 | 8/2005 | Ramson |
| 2006/0265828 | A1 | 11/2006 | Mallatt et al. |

OTHER PUBLICATIONS

Stainz-R-Out Moppers Microfiber Dust Slipper at HSN.com, http://catalog.hsn.com/prod-167na/hp!sf/2589407.htm, Feb. 28, 2007.

Casual Living Spring 2007, p. 37, Item G (#660959)—Sweep Them Off Their Feet, CasualLivingUSA.com.

FOOT-WORN SCRUBBING APPARATUS

This application is a continuation of U.S. patent application Ser. No. 11/684,609 filed Mar. 10, 2007 now U.S. Pat. No. 7,845,043.

FIELD OF THE DISCLOSURE

This disclosure relates generally to cleaning implements for use in a household environment. In particular, the disclosure relates to a foot-worn scrubbing device for scrubbing surfaces that may be difficult to reach or that cause physical discomfort when being scrubbed by hand such as in a bathtub, shower, hot tub, swimming pool or other area.

BACKGROUND OF THE DISCLOSURE

In order to clean the surfaces of some areas such as a bath tub, for example, one may need to bend or to position one's self on hands and knees to be able to clean the entire surface by hand. If a person has suffered a back injury, or a shoulder injury, or has a loss of upper body strength, or has lost an arm, or the use of an arm, or has difficulty bending, it may be problematic to reach portions of some surfaces or it may cause physical discomfort to be placed in a position necessary to clean the surfaces of such areas.

One way to address such a problem might be to use a long handled cleaning device such as a brush or a sponge mop to reach into hard to reach areas. Yet, it may still prove difficult to adequately clean, in their entirety, the surfaces of some areas or to apply the force necessary to scrub such surfaces due to the shape or configuration of the long handled cleaning device, or due to a lack of upper body strength or mobility, or due to an injury, or due to some combination of these or other factors.

Another attempt at solving such a problem might be to use a spray-on chemical cleaner that does not require scrubbing. Yet, such chemical cleaners may not be adapted to all cleaning needs and as such may not satisfactorily address each particular situation. Use of more than one chemical cleaner may be necessary and still may not adequately clean some surfaces, causing one to resort once again to scrubbing.

What is desired is an alternative that provides for scrubbing surfaces that may be difficult to reach and/or may cause physical discomfort when attempting to scrub them by hand, in such a way as to avoid the difficulties and/or physical discomforts of actually scrubbing them by hand.

BRIEF DESCRIPTION OF THE DRAWINGS

The present invention is illustrated by way of example and not limitation in the figures of the accompanying drawings.

DETAILED DESCRIPTION

A foot-worn scrubbing apparatus is herein disclosed. One embodiment of the apparatus comprises a sole made of a suitable material and having a top surface and a bottom surface. A scrubbing surface of another suitable material is adhered to the bottom surface of the sole. The sole is also attached to a thong in order to secure the sole and the scrubbing surface to a bare foot or to a socked foot of a user.

These and other embodiments of the present invention may be realized in accordance with the following teachings and it should be evident that various modifications and changes may be made in the following teachings without departing from the broader spirit and scope of the invention. The specification and drawings are, accordingly, to be regarded in an illustrative rather than restrictive sense and the invention measured only in terms of the claims and their equivalents.

For the purpose of the following discussion a thong may refer to: a strap or a lash that may be made of leather, fabric(s), rope, string, yarn or cord of natural or synthetic materials including elastic cords; a strap or straps associated with holding a sandal to the foot; or all or an upper portion of a flip-flop, sandal or slipper.

It will be appreciated that a foot-worn scrubbing apparatus as disclosed herein provides for scrubbing surfaces that may be difficult to reach and/or may cause physical discomfort when attempting to scrub them by hand. By scrubbing such surfaces using a foot-worn scrubbing apparatus from a standing or from a seated position the user may avoid the difficulties and/or physical discomforts of scrubbing the surfaces by hand.

Figure 1A:
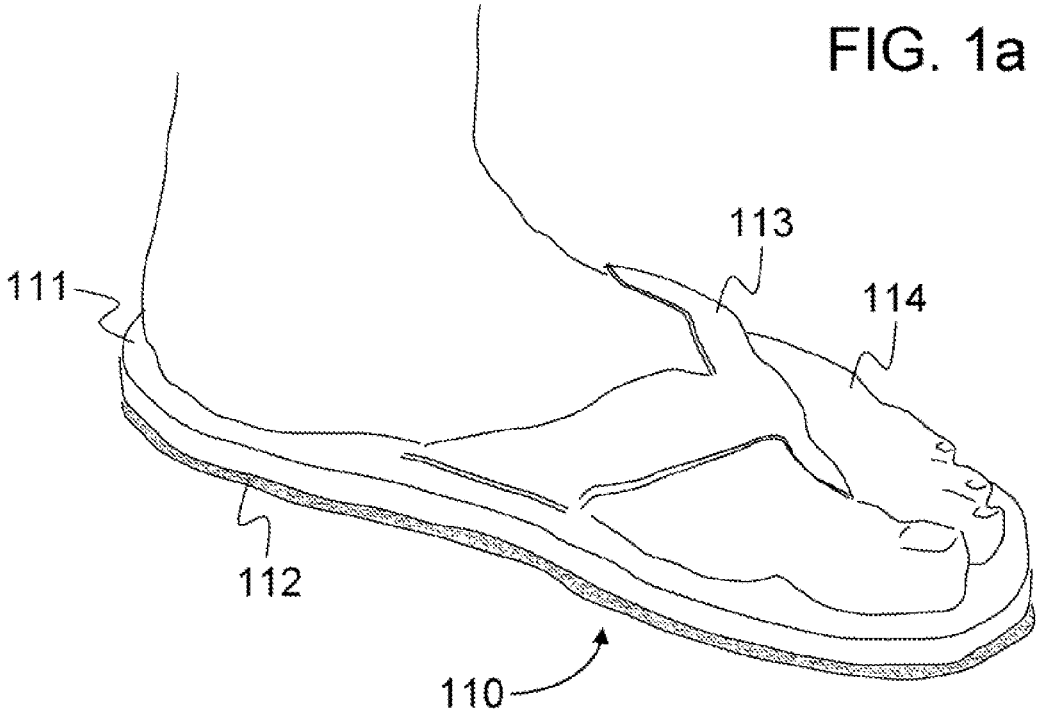
FIGS. 1*a-b* illustrate embodiments of a foot-worn scrubbing apparatus.

FIG. 1*a* illustrates an embodiment of a foot-worn household scrubbing apparatus 110. Scrubbing apparatus 110 includes a sole 111 having a top surface and a bottom surface. Sole 111 is of a suitable material or combination of materials to form the foot-worn household scrubbing apparatus 110. Such materials may include but are not limited to: a cellulose sponge, optionally including additional fibers, sodium sulphate and/or possible other chemicals; cork; foam rubber; neoprene; nylon; polyester; polyvinyl chloride leather; polyurethane foam; ethylene-vinyl acetate foam; or some other thermoplastic foam. The sole 111 is to underlie a portion of a user's bare foot (or socked foot as will be described further with regard to FIG. 1*b*).

Scrubbing apparatus 110 further includes a scrubbing surface 112 adhered or attached to the bottom surface of sole 111. Scrubbing surface 112 is also of a suitable material or combination of materials to form the foot-worn household scrubbing apparatus 110. One such material, for example, may include but is not limited to a non-woven web of nylon fibers optionally impregnated with a suitable abrasive. In some embodiments, scrubbing surface 112 may be removably attached with sole 111, for example, by a hook and loop fastener such as the Velcro® fasteners (Velcro is a registered trademark of Velcro Industries B.V.).

Scrubbing apparatus 110 further includes a thong 113 attached to the sole 111 to secure the sole 111 to the bare foot 114 (or to a socked foot 115 as in FIG. 1*b*) of the user.

Embodiments of scrubbing apparatus 110 may include a thong 113 of a variety of styles of manufacture and materials including but are not limited to: elastic; natural and/or synthetic woven fabric(s); rubber; nylon; polyester; polyvinyl chloride, polyurethane; ethylene-vinyl acetate foam; or some other molded thermoplastic foam.

Figure 1B:
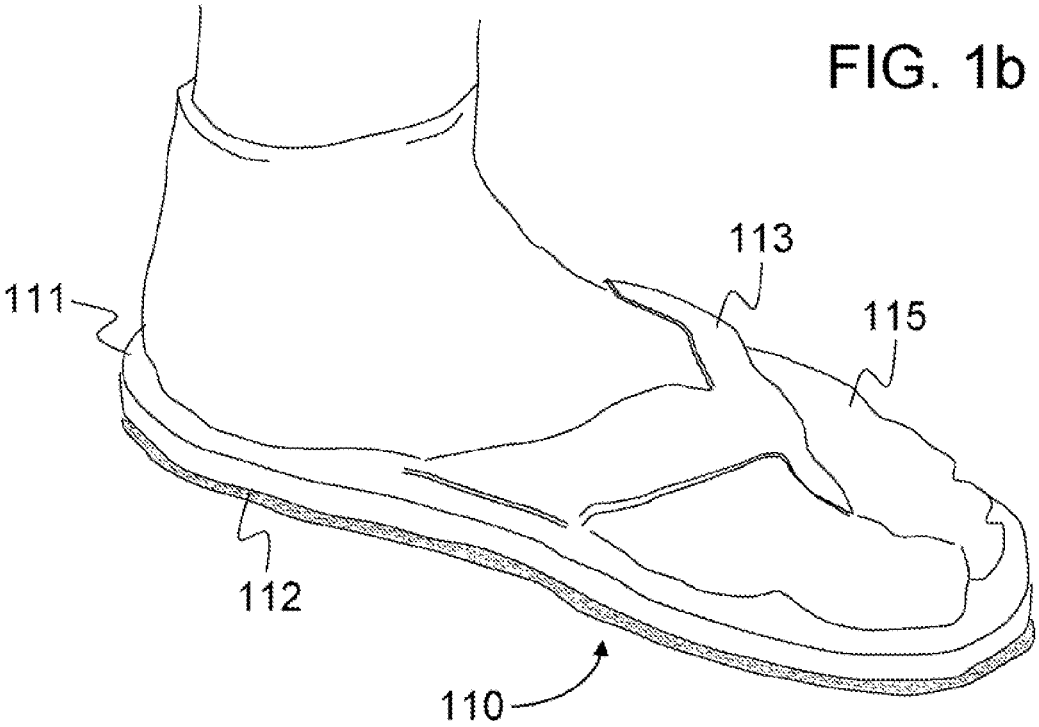

FIG. 1*b* further illustrates one embodiment of the foot-worn household scrubbing apparatus 110 including thong 113 to secure the sole 111 to a socked foot 115 of the user. It will be appreciated that a sock may be used in combination with scrubbing apparatus 110, for example, to protect the user from exposure to chemicals and/or abrasives or to help prevent exposure to biological contaminants or infections. Socks of a variety of materials may be used in combination with scrubbing apparatus 110 including but not limited to: latex; vinyl; butyl, nitrile or natural rubber; and neoprene.

Figure 2:
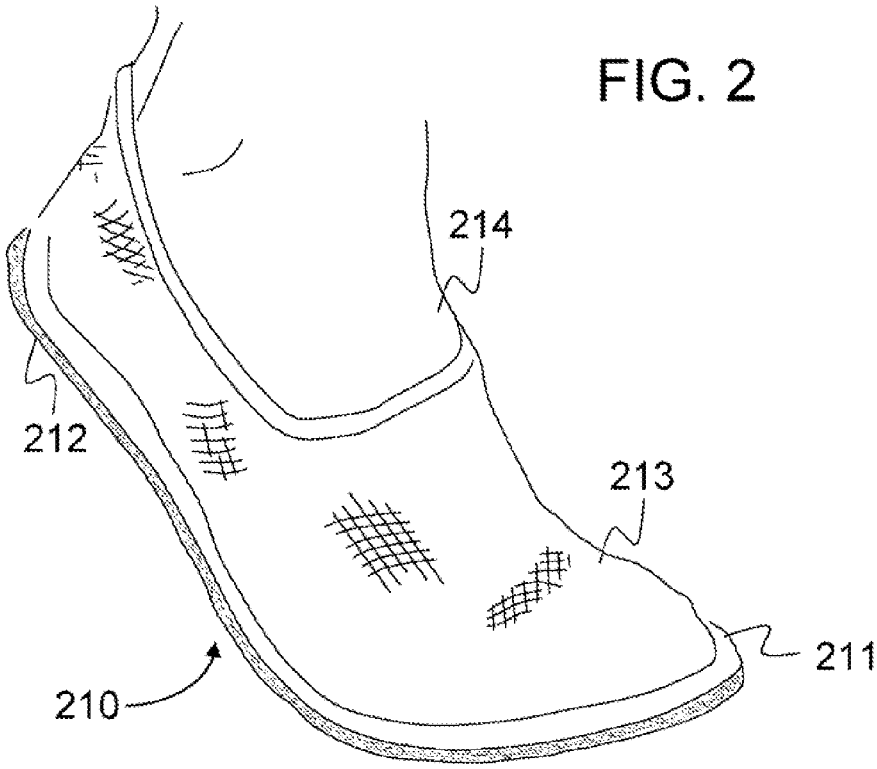
FIG. 2 illustrates an alternative embodiment of a foot-worn scrubbing apparatus.

FIG. 2 illustrates an alternative embodiment of a slipper or foot-worn scrubbing apparatus 210 for cleaning of household surfaces by foot. Scrubbing apparatus 210 includes a sole 211 having a top surface and a bottom surface. Sole 211 is of a suitable material or combination of materials to form the foot-worn scrubbing apparatus 210. Scrubbing apparatus 210 further includes a scrubbing surface 212 adhered or attached to the bottom surface of sole 211. Scrubbing surface 212 is also of a suitable material or combination of materials to form the foot-worn household scrubbing apparatus 210.

Scrubbing apparatus 210 further includes one or more cord or thong 213 attached to the sole 211 to secure the sole 211 to the bare foot 214 (or to a socked foot, not shown) of the user. It will be appreciated that embodiments of scrubbing apparatus 210 may include one or more cord or thong 213 of a variety of styles of manufacture and materials including but not limited to: leather, fabric(s), rope(s), string(s), yarn(s) or cord(s) of natural or synthetic materials including elastic cords. In some embodiments, the one or more cord or thong 213 may form a net or mesh, woven or knit together in any one of a variety of ways to secure the sole 211 to the bare foot 214.

Figure 3:
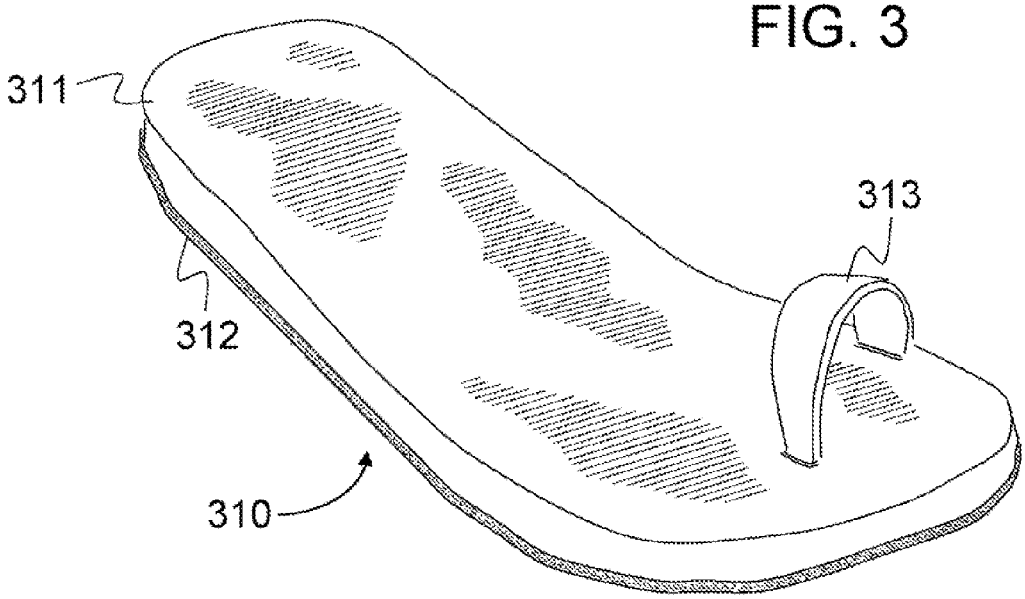
FIG. 3 illustrates another alternative embodiment of a foot-worn scrubbing apparatus.

FIG. 3 illustrates another alternative embodiment of a foot-worn apparatus or sandal 310 for scrubbing of household surfaces by foot. Sandal 310 includes a sole 311 of a suitable material or combination of materials to form the foot-worn household scrubbing apparatus or sandal 310. Sole 311 has a top surface and a bottom surface. A scrubbing surface 312 is coupled with the bottom surface of the sole 311. Scrubbing surface 312 is also of a suitable material or combination of materials to form the foot-worn household scrubbing apparatus or sandal 310. It will be appreciated that sole 311 and/or scrubbing surface 312 may include adhesives and/or fasteners to coupled the bottom surface of sole 311 with scrubbing surface 312. A thong 313 is coupled with the sole 311 to secure the sole 311 to a bare foot or to a socked foot (not shown) of a user proximate the top surface of the sole 311.

Figure 4:
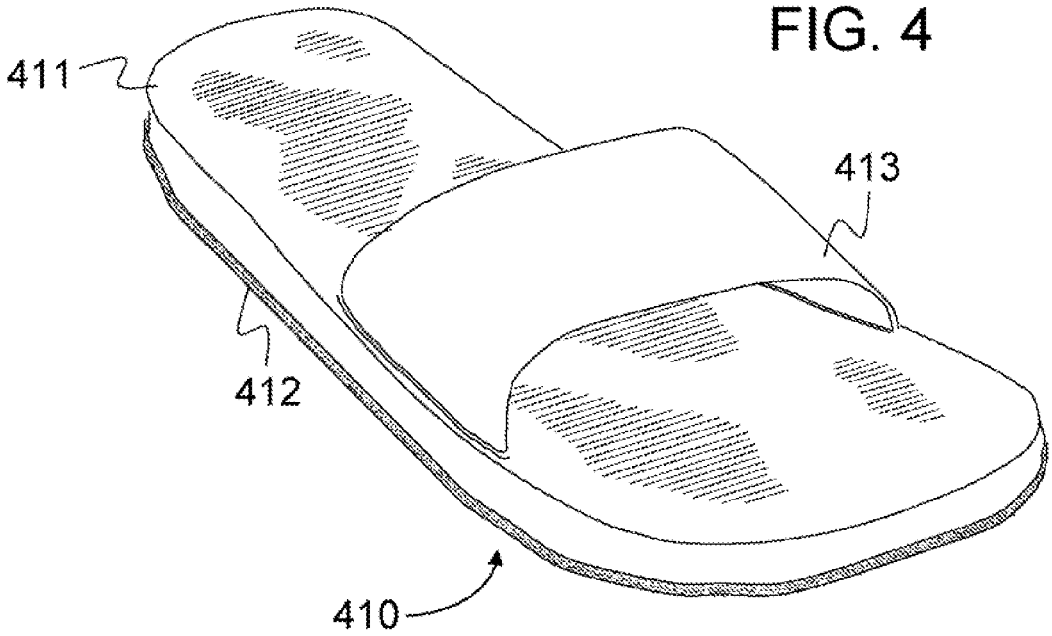
FIG. 4 illustrates another alternative embodiment of a foot-worn scrubbing apparatus.

FIG. 4 illustrates another alternative embodiment of a foot-worn household scrubbing apparatus 410. Scrubbing apparatus 410 includes a sole 411 of a suitable material or combination of materials to form the foot-worn scrubbing apparatus 410. Scrubbing apparatus 410 further includes a scrubbing pad 412 adhered or attached to the bottom surface of sole 411. Scrubbing pad 412 is also of a suitable material or combination of materials to form the foot-worn household scrubbing apparatus 410. Scrubbing apparatus 410 further includes a strap or thong 413 attached to the sole 411 to secure the sole 411 to the bare foot or to a socked foot (not shown) of the user.

It will be appreciated that embodiments of scrubbing apparatus 410 and other disclosed embodiments may provide a user with an alternative for cleaning surfaces that may have here to fore been challenging, for example, the bottom and sides of swimming pools or hot tubs. Use of a foot-worn scrubbing apparatus may permit scrubbing of such surfaces to clean algae or other deposited materials without requiring the user to drain the water or to submerge their head or to hold their breath in order to scrub by hand.

Figure 5:
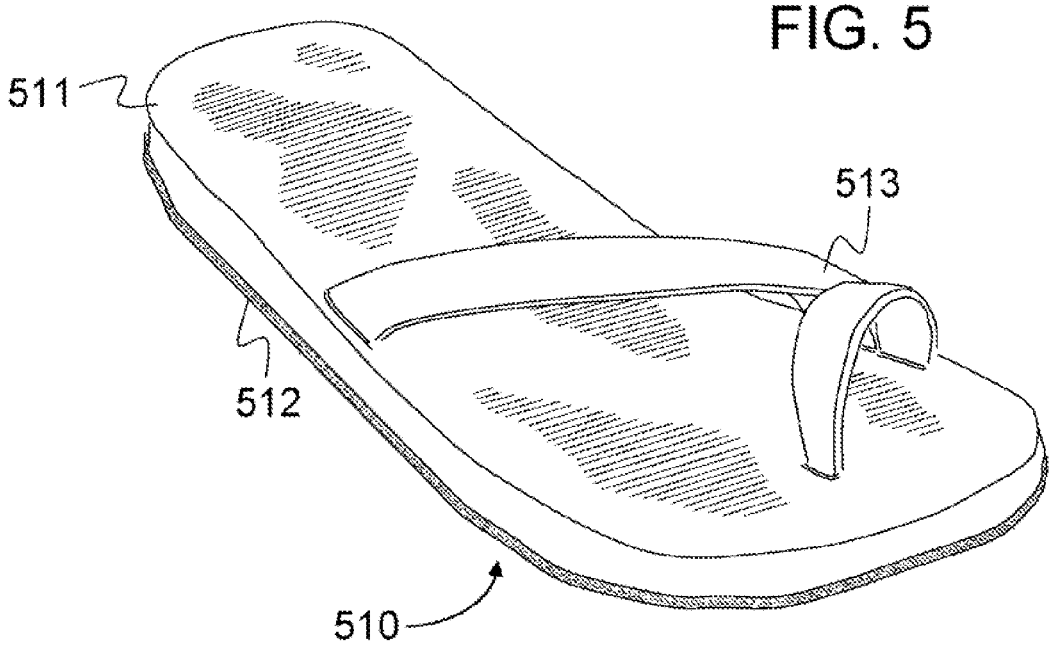
FIG. 5 illustrates another alternative embodiment of a foot-worn scrubbing apparatus.

FIG. 5 illustrates another alternative embodiment of a foot-worn apparatus or sandal 510 for cleaning of household surfaces by foot. Sandal 510 includes a sole 511 of a suitable material or combination of materials to form the foot-worn household scrubbing apparatus or sandal 510. A scrubbing surface 512 is coupled with the bottom surface of the sole 511. Scrubbing surface 512 is also of a suitable material or combination of materials to form the foot-worn household scrubbing apparatus or sandal 510. One or more thong 513 is also coupled with the sole 511 to secure the sole 511 to a bare foot or to a socked foot (not shown) of a user proximate the top surface of the sole 511.

Figure 6:
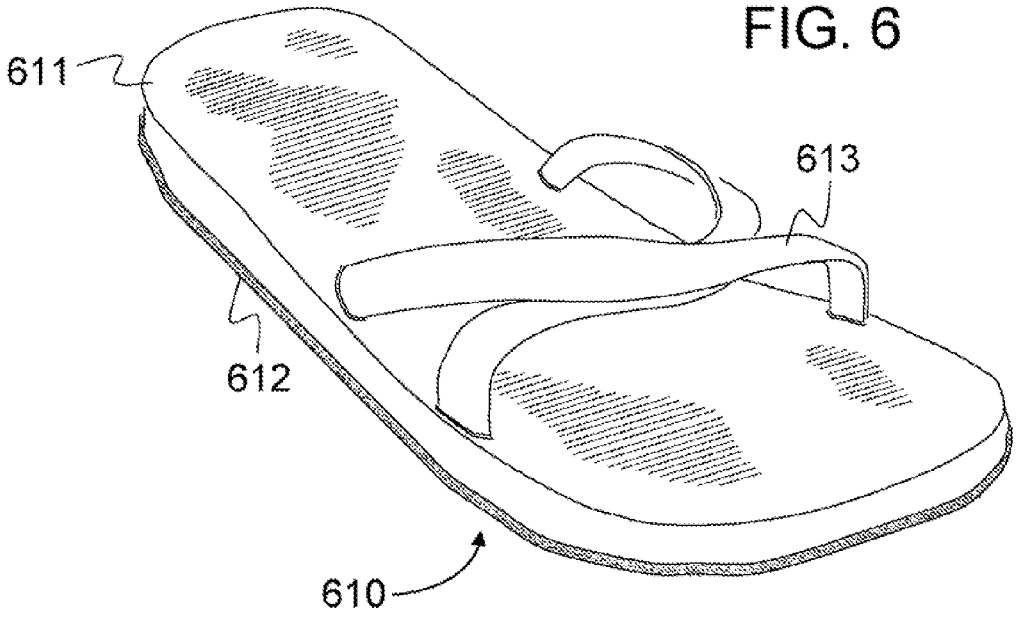
FIG. 6 illustrates another alternative embodiment of a foot-worn scrubbing apparatus.

FIG. 6 illustrates another alternative embodiment of a foot-worn household scrubbing apparatus 610. Scrubbing apparatus 610 includes a sole 611 of a suitable material or combination of materials to form the foot-worn scrubbing apparatus 610. Scrubbing apparatus 610 further includes a scrubbing surface 612 adhered or attached to the bottom surface of sole 611. Scrubbing surface 612 is also of a suitable material or combination of materials to form the foot-worn household scrubbing apparatus 610. Scrubbing apparatus 610 further includes one or more thong 613 attached to the sole 611 to secure the sole 611 to the bare foot or to a socked foot (not shown) of the user.

Figure 7:
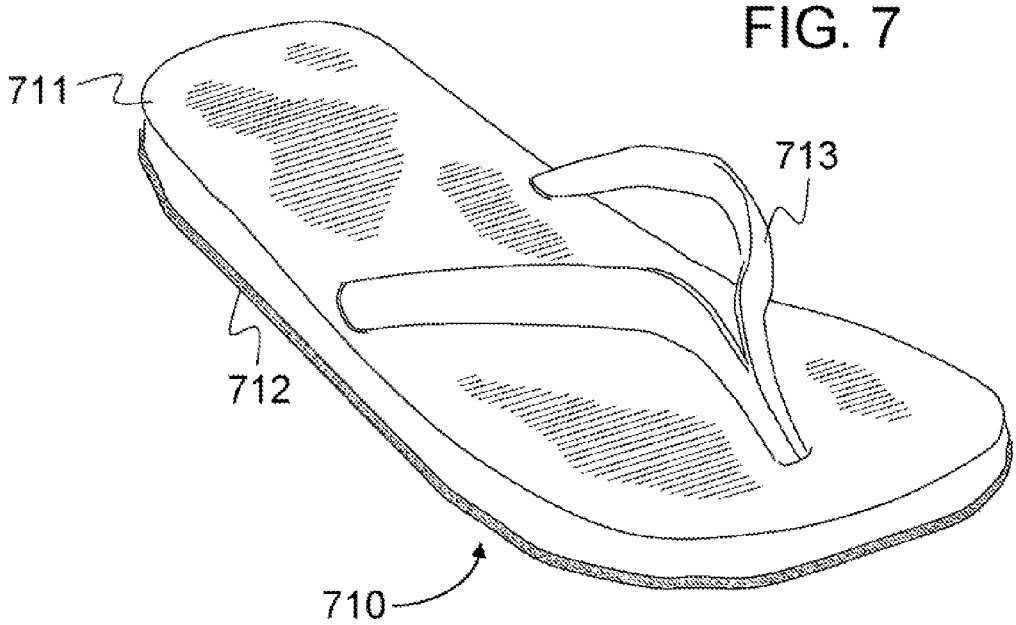
FIG. 7 illustrates another alternative embodiment of a foot-worn scrubbing apparatus.

FIG. 7 illustrates another alternative embodiment of a foot-worn apparatus or sandal 710 for cleaning of household surfaces by foot. Sandal 710 includes a sole 711 of a suitable material or combination of materials to form the foot-worn household scrubbing apparatus or sandal 710. A scrubbing surface 712 is coupled with the bottom surface of the sole 711. Scrubbing surface 712 is also of a suitable material or combination of materials to form the foot-worn household scrubbing apparatus or sandal 710. One or more thong 713 is also coupled with the sole 711 to secure the sole 711 to a bare foot or to a socked foot (not shown) of a user proximate the top surface of the sole 711.

Figure 8:
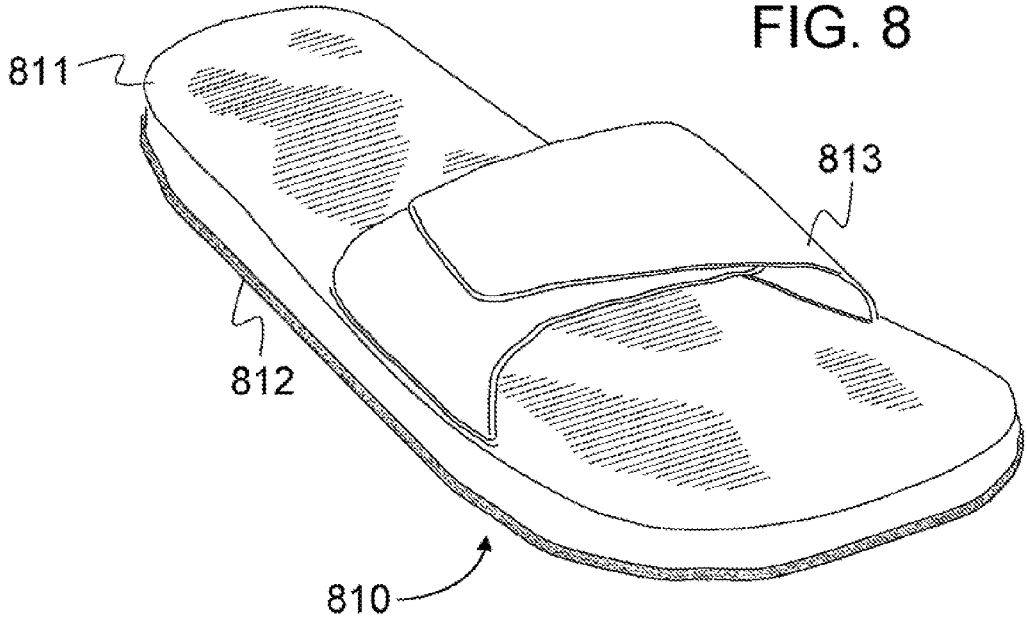
FIG. 8 illustrates another alternative embodiment of a foot-worn scrubbing apparatus.

FIG. 8 illustrates another alternative embodiment of a foot-worn household scrubbing apparatus or sandal 810. Sandal 810 includes a sole 811 of a suitable material or combination of materials to form the foot-worn household scrubbing apparatus or sandal 810. Sole 811 has a top surface and a bottom surface. A scrubbing surface 812 is coupled with the bottom surface of the sole 811. Scrubbing surface 812 is also of a suitable material or combination of materials to form the foot-worn household scrubbing apparatus or sandal 810. One or more thong 813 is coupled with the sole 811 to secure the sole 811 to a bare foot or to a socked foot (not shown) of a user proximate the top surface of the sole 811. Some embodiments of sandal 810 may include one or more thong 813 that are adjustable to better fit the foot of the user, for example by use of adjustable fasteners such as hook and loop fasteners like Velcro® fasteners.

Figure 9:
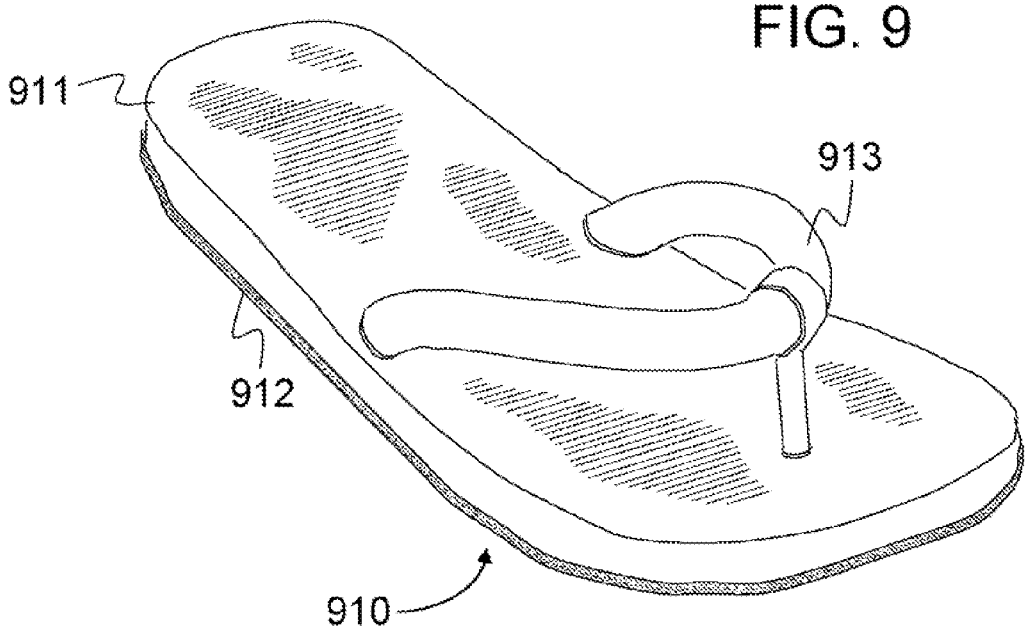
FIG. 9 illustrates another alternative embodiment of a foot-worn scrubbing apparatus.

FIG. 9 illustrates another alternative embodiment of a foot-worn household scrubbing apparatus 910. Scrubbing apparatus 910 includes a sole 911 of a suitable material or combination of materials to form the foot-worn scrubbing apparatus 910. Scrubbing apparatus 910 further includes a scrubbing surface 912 adhered or attached to the bottom surface of sole 911. Scrubbing surface 912 is also of a suitable material or combination of materials to form the foot-worn household scrubbing apparatus 910. Scrubbing apparatus 910 further includes a thong 913 attached to the sole 911 to secure the sole 911 to the bare foot or to a socked foot (not shown) of the user. It will be appreciated that in some embodiments of scrubbing apparatus 910, the thong 913 may be positioned in such a way that the scrubbing apparatus 910 is symmetric and hence can be worn on either foot of the user.

It will be appreciated that embodiments of the foot-worn scrubbing apparatus 910 and other disclosed embodiments may provide a user with alternatives for cleaning a number of other surfaces including but not limited to: boats, vehicle floor mats, decking, stairs, floors, sidewalks, and curbs.

Some embodiments of a foot-worn scrubbing apparatus may optionally employ replaceable combinations of disposable scrubbing pads with or without disposable soles to be used with a single non-disposable thong or sandal.

Figure 10A:
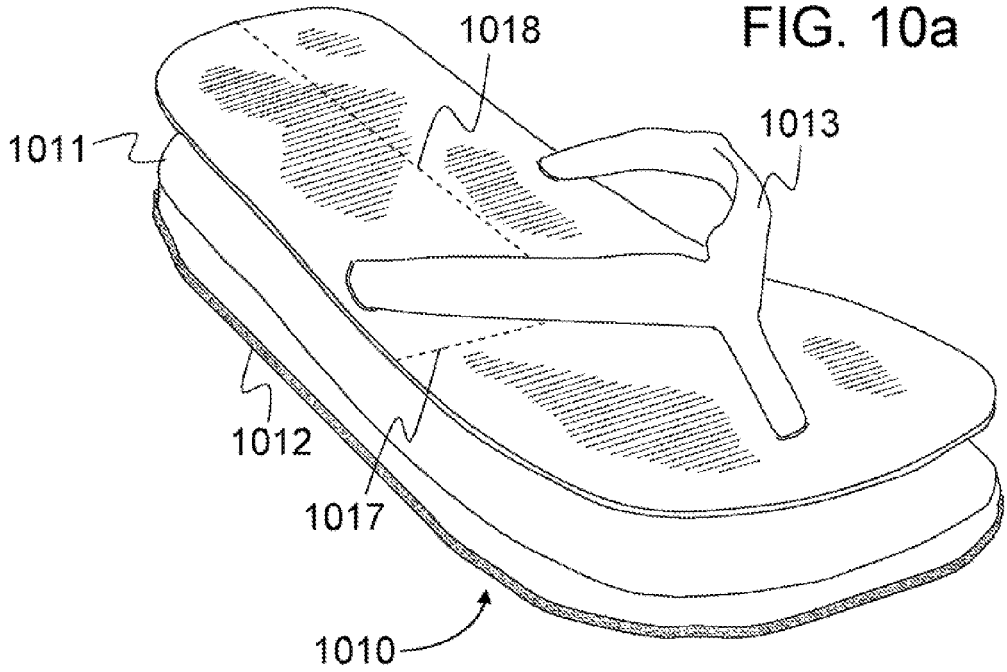
FIGS. 10*a-b* illustrate alternative embodiments of foot-worn scrubbing apparatus.

FIG. 10*a* illustrates an alternative embodiment of foot-worn household scrubbing apparatus 1010. Foot-worn scrubbing apparatus 1010 includes a scrubbing pad 1012 adhered or attached to the bottom surface of sole 1011. Scrubbing pad 1012 is of a suitable material or combination of materials to form the foot-worn household scrubbing apparatus 1010, such as, for example, a non-woven web of nylon fibers optionally impregnated with a suitable abrasive or cleanser. Sole 1011 is also of a suitable material or combination of materials to form the foot-worn household scrubbing apparatus 1010. In some embodiments sole 1011 may include a material suitable for attachment and detachment such as a loop material as used in hook and loop fasteners, for example, like Velcro® fasteners.

Scrubbing apparatus 1010 further includes a thong 1013 attachable with the sole 1011 to secure the scrubbing pad 1012 to the bare foot or to a socked foot of a user. Some embodiments of scrubbing apparatus 1010 may include a thong 1013 having hook type fasteners suitable for attachment and detachment with sole 1010. In some embodiments, thong 1013 may be directly attachable with the scrubbing pad 1012 and the sole 1011 is optional. It will be appreciated that thong 1013 need not necessarily underlie the entire foot of a user in order to secure the scrubbing pad 1012. Some alternative embodiments may optionally provide for adjustment of thong 1013 to better fit the foot of the user, for example by cutting thong 1013 in the proximity of line 1017 and/or line 1018.

It will be appreciated that in the use of foot-worn household scrubbing apparatus 1010, multiple replaceable combinations of a disposable scrubbing pad 1012 and sole 1011 may be used with a single thong 1013, thus reducing the cost of replacing the entire scrubbing apparatus 1010.

Figure 10B:
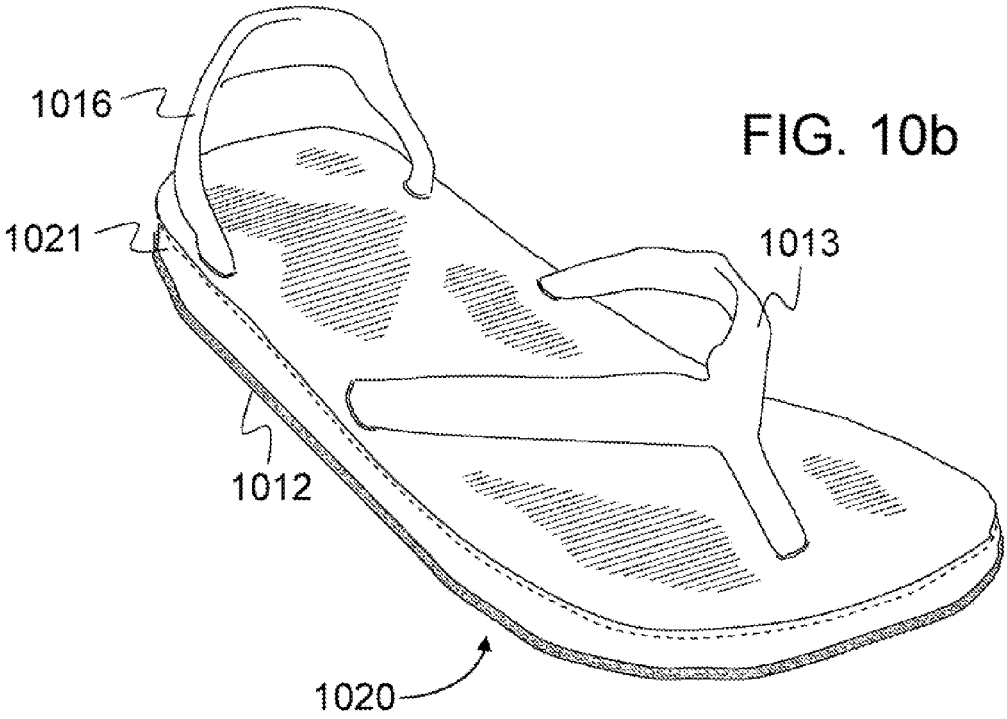

FIG. 10*b* illustrates another alternative embodiment of foot-worn household scrubbing apparatus 1020. Again sole 1021 is of a suitable material or combination of materials to form the foot-worn household scrubbing apparatus 1020 and may optionally include a material suitable for attachment and detachment such as a loop material as used in hook and loop fasteners, for example. Embodiments of scrubbing apparatus 1020 further includes a heel strap 1016 operatively attached with thong 1013 to secure the scrubbing pad 1012 to the bare foot or to the socked foot of the user. It will be appreciated that heel strap 1016 may also be of a variety of styles of manufacture and materials including but are not limited to: elastic; natural and/or synthetic woven fabric(s); rubber; nylon; polyester; polyvinyl chloride, polyurethane; ethylene-vinyl acetate foam; or some other molded thermoplastic foam.

Figure 11A:
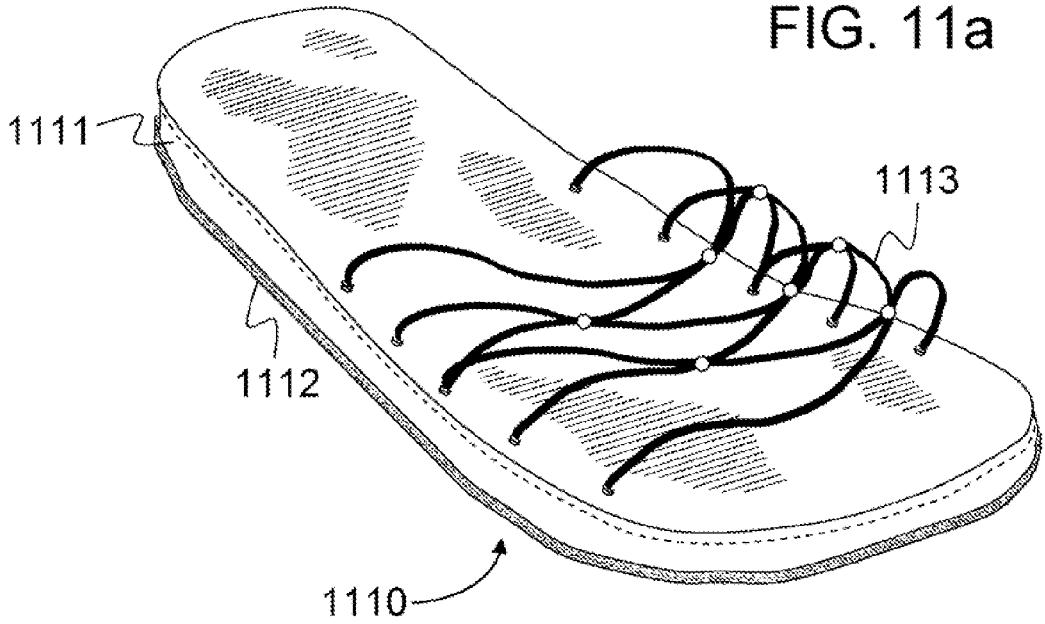
FIGS. 11*a-b* illustrate alternative embodiments of foot-worn scrubbing apparatus.

FIG. 11*a* illustrates an alternative embodiment of foot-worn household scrubbing apparatus 1110. Foot-worn scrubbing apparatus 1110 includes a scrubbing pad 1112 adhered or attached to the bottom surface of sole 1111. Sole 1111 and scrubbing pad 1112 are of suitable materials or combinations of materials to form the foot-worn household scrubbing apparatus 1110. In some embodiments sole 1110 may optionally include a material suitable for attachment and detachment such as a loop material as used in hook and loop fasteners.

Scrubbing apparatus 1110 further includes a thong 1113 attachable with the sole 1111 to secure the scrubbing pad 1112 to the bare foot or to a socked foot (not shown) of a user. Some embodiments of scrubbing apparatus 1110 may include a thong 1113 having hook type fasteners suitable for attachment and detachment with sole 1110. In some embodiments, thong 1113 may be directly attachable with the scrubbing pad 1112 and the sole 1111 is optional. It will be appreciated that thong 1113 need not necessarily underlie the entire foot of a user in order to secure the scrubbing pad 1112. Some embodiments of scrubbing apparatus 1110 may use a variety of styles of manufacture and materials including but not limited to elastic bungee cords to provide for an adjustment of thong 1113 to better fit the foot of the user.

Figure 11B:
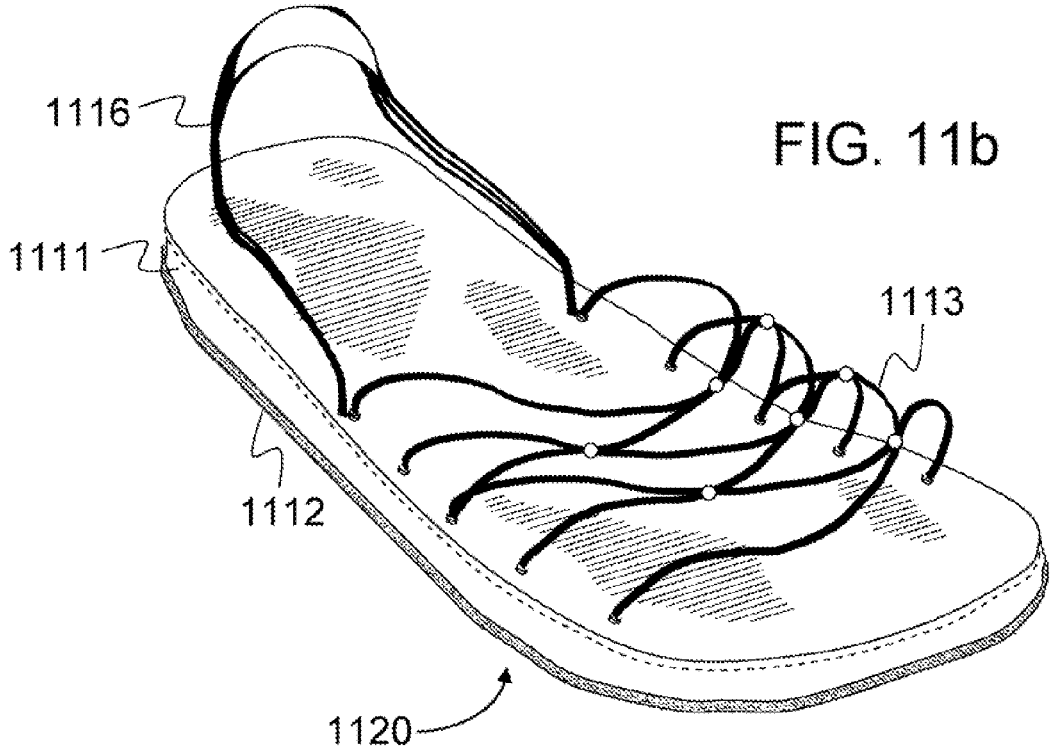

FIG. 11*b* illustrates another alternative embodiment of foot-worn household scrubbing apparatus 1120. Embodiments of scrubbing apparatus 1120 further includes one or more heel strap 1116 operatively attached with thong 1113 to secure the scrubbing pad 1112 to the bare foot or to the socked foot of the user. It will be appreciated that heel strap 1116 may also be of a variety of styles of manufacture and materials including but not limited to elastic bungee cords.

The above description is intended to illustrate preferred embodiments of the present invention. From the discussion above it should also be apparent that the invention may be modified in arrangement and detail by those skilled in the art without departing from the principles of the present invention within the scope of the accompanying claims and their equivalents.

What is claimed is:

1. A foot-worn scrubbing apparatus comprising:

a sole of a material or combination of materials comprising a sponge and made at least in part of a first material, having a top surface and a bottom surface, and suitable to form the foot-worn scrubbing apparatus, the sole to underlie a portion of a bare foot or of a socked foot of a user;

a scrubbing surface comprising a non-woven web of nylon fibers adhered to the sole proximate the bottom surface; and a thong attached to the sole to secure the sole to said bare foot or to said socked foot of the user.

2. The apparatus of claim 1 wherein the first material of the sole comprises polyester.

3. The apparatus of claim 1 wherein the first material of the sole comprises polyurethane foam.

4. The apparatus of claim 1 wherein the thong comprises elastic.

5. The apparatus of claim 1 wherein the thong provides for an adjustment to better fit the foot of the user.

6. The apparatus of claim 1 wherein the thong comprises molded thermoplastic foam.

7. The apparatus of claim 1 further comprising:

a rubber latex sock to be worn upon the bare foot of a user.

8. A sandal for cleaning of household surfaces by foot, the sandal comprising:

a sole constructed at least in part of sponge, the sole having a top surface and a bottom surface;

a scrubbing surface including a second material, the scrubbing surface coupled with the bottom surface of the sole; and a thong coupled with the sole to secure the sole to a bare foot or to a socked foot of a user proximate the top surface of the sole.

9. The sandal of claim 8 wherein the second material of the scrubbing surface comprises a non-woven web of nylon fibers.

10. The sandal of claim 8, said sole including a first material wherein the first material of the sole comprises polyester.

11. The sandal of claim 8, said sole including a first material wherein the first material of the sole comprises polyurethane foam.

12. The sandal of claim 8 wherein the thong comprises elastic.

13. The sandal of claim 8 wherein the thong comprises plastic.

14. The sandal of claim 8 wherein an adjustment of the thong is provided to better fit the foot of the user.

15. A foot-worn scrubbing apparatus comprising:

a scrubbing pad of a first material suitable for cleaning household surfaces while attached to a user's foot;

a thong to secure the scrubbing pad to a bare foot or to a socked foot of the user; and a sole constructed at least in part of a sponge and comprising a second material, the sole having a top surface and a bottom surface coupled with the scrubbing pad, the sole attachable proximate the top surface to said thong for securing the scrubbing pad to a bare foot or to a socked foot of the user.

16. The apparatus of claim 15 wherein the first material of the scrubbing pad comprises a non-woven web of nylon fibers.

17. The apparatus of claim 16 wherein the second material of the sole comprises polyester.

18. The apparatus of claim 16 wherein the second material of the sole comprises polyurethane foam.

19. The apparatus of claim 16 further comprising:

a rubber latex sock to be worn upon the bare foot of the user.

20. The apparatus of claim 16 further comprising:

a vinyl sock to be worn upon the bare foot of the user.

* * * * *